US005563373A

United States Patent [19]

Doroslovac

[11] Patent Number: 5,563,373

[45] Date of Patent: Oct. 8, 1996

[54] SAFETY SHIELD FOR ELECTRICAL OUTLET

[76] Inventor: Slobodan Doroslovac, 1522 Lakeland Ave., Akron, Ohio 44320

[21] Appl. No.: 349,263

[22] Filed: Dec. 5, 1994

[51] Int. Cl.[6] ..... H01R 13/447

[52] U.S. Cl. ..... 174/67; 439/136

[58] Field of Search ..... 174/67; 439/135, 439/136, 145

[56] References Cited

U.S. PATENT DOCUMENTS

| | | | |
|---|---|---|---|
| 2,820,842 | 1/1958 | Meistrell | 220/242 |
| 4,774,384 | 9/1988 | Gregory | 174/67 |
| 4,798,916 | 1/1989 | Engel | 174/67 |
| 5,026,299 | 6/1991 | Foulk | 439/137 |
| 5,240,426 | 8/1993 | Barla | 439/136 |
| 5,449,860 | 9/1995 | Buckshaw et al. | 174/67 |

*Primary Examiner*—Laura Thomas
*Assistant Examiner*—Paramita Ghosh
*Attorney, Agent, or Firm*—Oldham & Oldham Co. L.P.A.

[57] ABSTRACT

A safety device replaces the cover plate of a wall-mounted electrical outlet box having a pair of female receptacles for receiving a male plug. The safety device has a face plate, a back plate, a pair of shutters and a biasing means. The face plate has a front face and an opposing back face. The face plate has two large apertures in it, corresponding to the two female receptacles and exposing the receptacles when the face plate is positioned atop the outlet box and secured to it. The back plate has a inner surface and an outer surface and an aperture, which is shaped and positioned to correspond to the pair of female receptacles. When the front plate and back plate are mated, the front plate and the back plate are joined with the back face of the front plate, the inner surface of the back plate and a pair of parallel flanges on the back face defining a channel. First and second shutters, corresponding to each of the large apertures on the face plate, cover the apertures. Each shutter is an imperforate shield member with an arm extending from each side and is positioned slidably within the channel so as to obstruct the corresponding large aperture completely when in a first position and to provide access to a male plug through the large aperture when in a second position. The shutters are biased into the closed first position by a biasing means, preferably a pair of rubber bands.

20 Claims, 3 Drawing Sheets

SAFETY SHIELD FOR ELECTRICAL OUTLET

The present invention relates to a safety shield for an electrical outlet. More particularly, it relates to a safety shield that is superimposed over the electrical outlet. Even more particularly, it relates to a safety shield that obstructs the set of female receptacles on the electrical outlet unless an imperforate shutter covering the female receptacles is opened, thereby allowing insertion of the male prongs of an electrical plug into the set of female receptacles on the outlet.

BACKGROUND OF INVENTION

Young children frequently insert objects into the female receptacles of electrical outlets while playing. This results in a dangerous situation where serious injury or death could result. A multitude of devices have been developed to attempt to mitigate this danger. One example is the non-conducting two- or three-pronged male adaptor cover which is inserted into the electrical outlet, thereby filling the female receptacles and effectively removing the danger of children inserting objects into the female receptacles. However, this male adaptor is easily removable by a child, thereby diminishing the safety feature. The user of the electrical outlet may also be inconvenienced by the need to always remove the male adaptor to use the electrical outlet and the lack of a convenient place to put the adaptor while using the electrical outlet, since the adaptor itself is almost as dangerous (as a choking hazard) as the female receptacle is a shock hazard. Finally, since the male adaptor needs to be fully removed to use the electrical outlet, the opportunity to forget to re-insert the male adaptor when finished defeats the purpose of the male adaptor. The patent literature is replete with many other attempts to increase the safety of electrical outlets, which bear a large portion of their danger due to their almost inevitable placement near the floor, clearly within the reach of small children.

In the standard electrical outlets used in the United States, the outlet has a cover plate and a pair of female receptacles housed within an outlet box, the cover plate typically being secured to the outlet box by a screw passing through an aperture between the female receptacles. The cover plate itself has a pair of larger apertures through which the female receptacles are completely exposed. This complete exposure is important to properly use the female receptacles, since the prongs on a male plug are not properly engaged with the female receptacle unless the male plug is able to mate in flush relationship with the female receptacle. When this flush mating occurs, apertures at the distal end of the male prongs engage projections inside the female receptacle, and this engagement assists in holding the male plug securely in place. In many prior art devices, flush mating of the male plug with the female receptacles has not been possible because of intervening parts of the safety device. Unless the safety device allows flush mating, the safety device may itself pose as much of a hazard as the unprotected situation it replaces.

Another hazard presented by some safety devices of the prior art is a shock hazard presented by the device itself. To be truly safe, the safety device should have no electrically conductive materials that could provide an electrical short circuit. Again, prior art safety devices contain metallic parts that may break or come loose, presenting a short circuit opportunity.

SUMMARY OF INVENTION

It is therefore an object of this invention to provide an electrical outlet having a safety feature where the safety feature: is easily installed over a standard outlet by replacing the standard cover plate; is simple for an adult to use; is difficult, if not impossible, for a child to use; and which automatically returns the outlet to a safe status when the electrical plug is removed from the outlet.

This and further objects are achieved by a safety device for covering a wall-mounted electrical outlet having a pair of female receptacles for receiving a male electrical plug. The safety device has a face plate, a back plate, a pair of shutters and a biasing means. The face plate has a front face and an opposing back face. The face plate has two large apertures in it, corresponding to the two female receptacles and exposing the receptacles when the face plate is positioned atop the outlet box and secured to it. The back plate has a inner surface and an outer surface and an aperture, which is shaped and positioned to correspond to the pair of female receptacles. When the front plate and back plate are mated, the front plate and the back plate are joined with the back face of the front plate, the inner surface of the back plate and a pair of parallel flanges on the back face defining a channel. First and second shutters, corresponding to each of the large apertures on the face plate, cover the apertures. Each shutter is an imperforate shield member with an arm extending from each side and is positioned slidably within the channel so as to obstruct the corresponding large aperture completely when in a first position and to provide access to a male plug through the large aperture when in a second position.

The shutters are biased into the closed first position by a biasing means, preferably a pair of rubber bands, where each rubber band connects a finger on one arm of one shutter with a corresponding finger on the corresponding arm of the other shutter. These shutters coact, so that when one shutter is in the second position, tension on the rubber bands increases the force required to open the other shutter to the second position.

Preferably the face plate and the backplate are mated by a plurality of raised posts on the back face of the front plate and a corresponding plurality of apertures through the back plate.

Preferably, the front plate has a flanged edge projecting from the periphery thereof, and the front plate has a tab extending outwardly from the back face thereof between the large apertures. The aperture on the back plate is preferably shaped like an hourglass. The arms of the shutters are offset slightly from the shield member and the inner surface of the back plate has a pair of parallel flanges molded thereon, so that the offset arms and parallel flanges interact to track the shutters within the channel.

The preferable safety device has the face plate, the back plate, the shutters and the biasing means all made from electrically non-conductive materials. The preferred material for the face plate, the back plate and the shutters is a thermoplastic material, such as an acrylonitrile-butadiene-styrene resin.

BRIEF DESCRIPTION OF THE DRAWINGS

The present invention will be best understood when reference is had to the attached drawings which are made a part hereof and wherein identical parts are indicated with identical numbers and wherein.

DESCRIPTION OF THE PREFERRED EMBODIMENT

Figure 1:
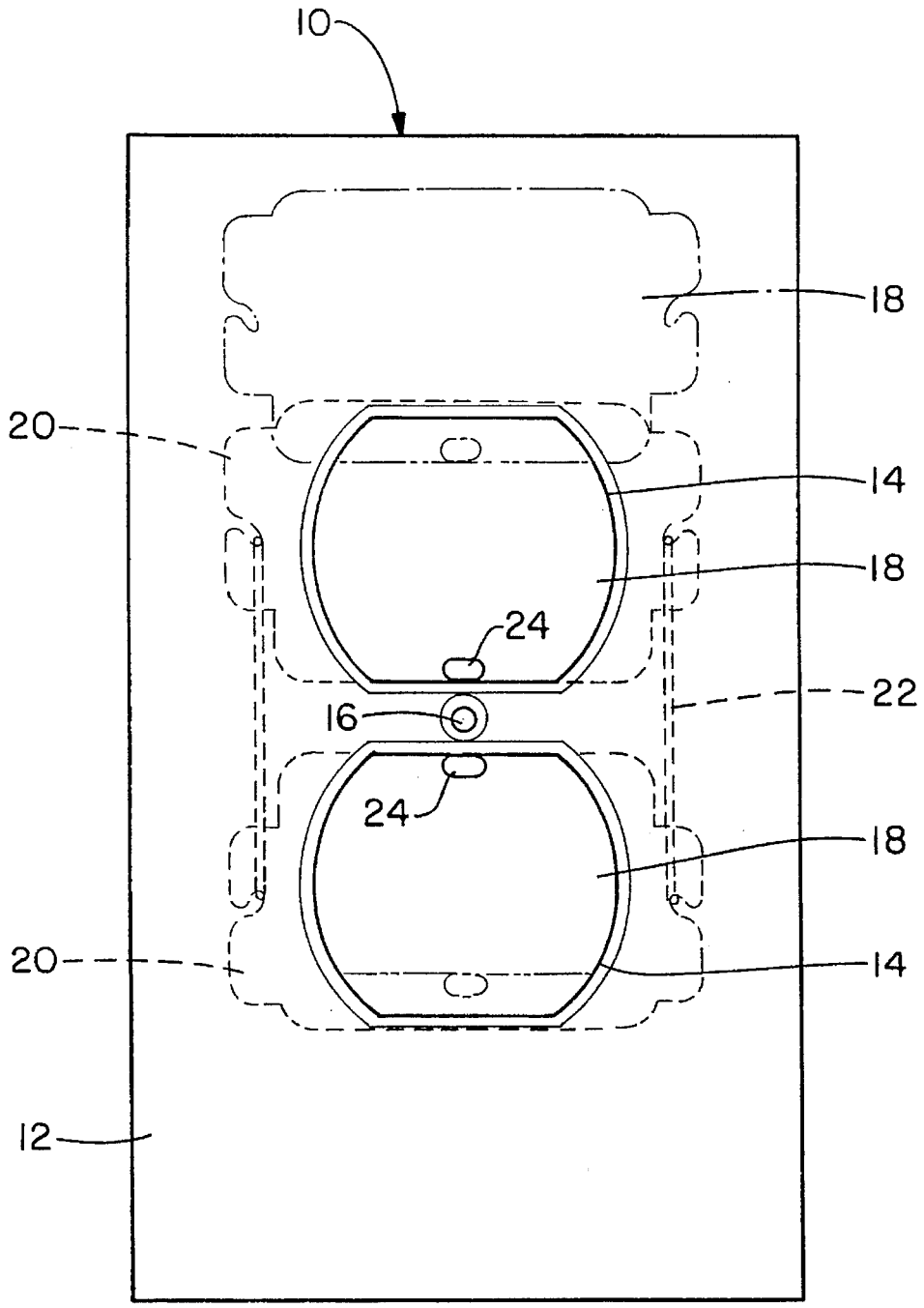
FIG. 1 is a front side plan view of the electrical outlet safety device of the present invention.
Figure 2:
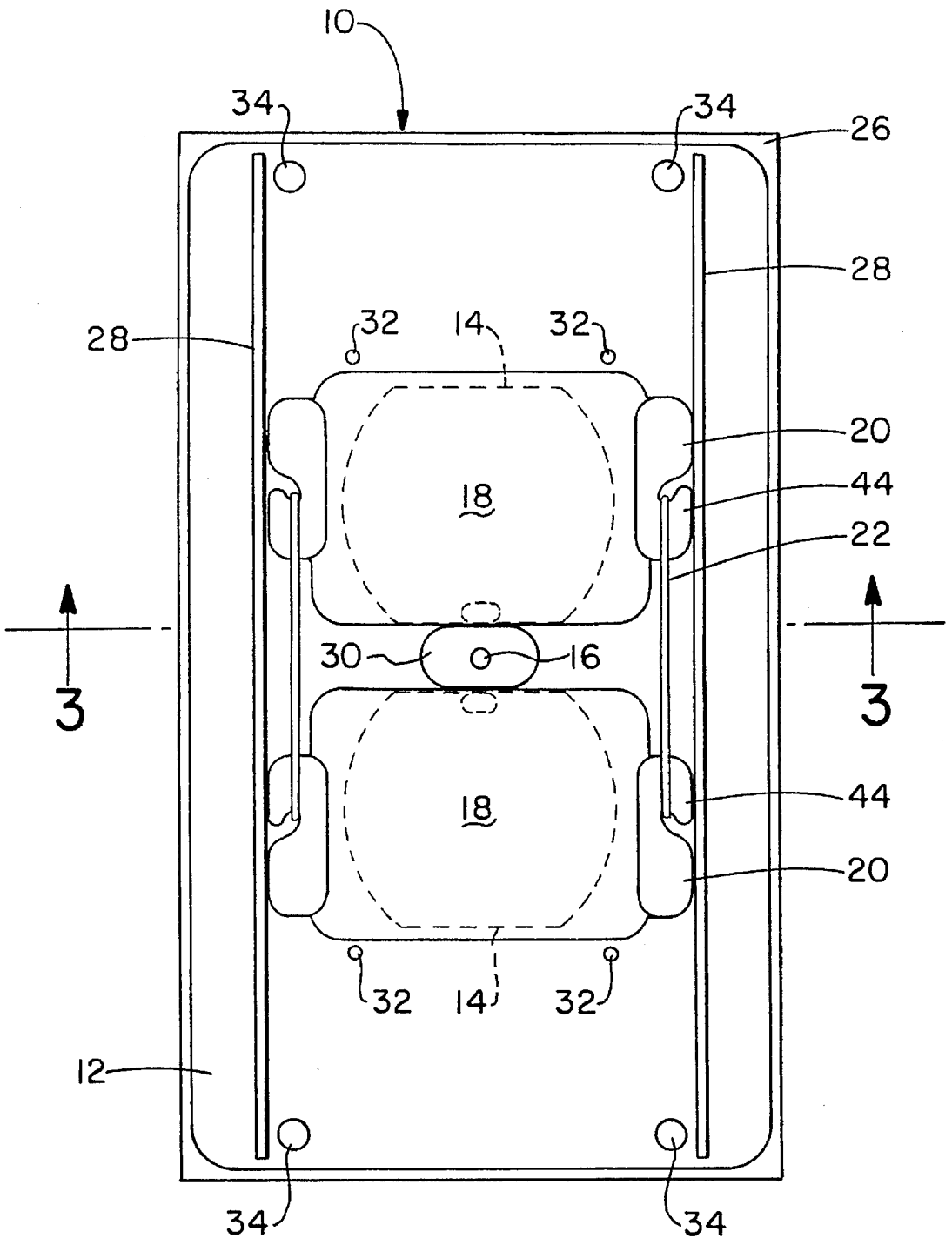
FIG. 2 is a back side plan view of the electrical outlet safety device with the back plate removed to illustrate the shutter mechanism of the safety device.

FIG. 1 shows a preferred embodiment 10 of the safety device of the present invention as it would be placed over a standard electrical outlet known in the prior art. The safety device 10 has a face plate 12, which is generally a rectangular body having a planar front surface. Prominently shown on the face plate 12 are a pair of large apertures 14, which are positioned so as to register over the female receptacles of the standard electrical outlet. To allow a male plug being engaged in one of the female receptacles to mount flush with the female receptacle, the large apertures 14 are preferably sized larger than the female receptacles underlying them, thereby fully exposing the female receptacle. A central small aperture 16 is positioned between the large apertures 14. This small aperture 16 is sized to receive a screw such as the screw that secures the cover plate of the electrical outlet to the outlet box, although it will be appreciated that a longer screw is used, since the face plate 12 is displaced somewhat further from the wall. In this manner, the safety device 10 is positionable atop the electrical outlet after removing the cover plate. Along the back face of the face plate 12, a pair of shutters 18 normally obstruct access to the female receptacles, although each of the shutters is slidable away from the central small aperture 16 to expose the large aperture 14 and the underlying female receptacle, as shown in phantom lines on FIG. 1. Each of the shutters 18 has a sidewardly extending arm 20 on each side thereof. As described more fully below, these arms 20 receive a biasing means 22 to urge the respective shutters 18 into the normally closed view shown in FIG. 1. In the portion of the shutter 18 always exposed through the large aperture 14, there is an outwardly extending tab 24, which facilitates movement of the shutter and provides a stop at each end of the shutter's range of movement, again as shown by the phantom lining, The back face of the face plate 12 is shown in FIG. 2, to which attention is now directed. A back plate, as be described further below, has been removed in this view to reveal features that would otherwise be hidden. As in FIG. 1, the large apertures 14 and the central small aperture 16 provide landmarks for placement of the parts. The entire periphery 26 of the face plate 12 is flanged to provide a flush fit of the face plate against the wall and to prevent insertion of objects around the face plate once it is secured in place over the outlet box. A pair of vertical flanges 28, one on each side of the large apertures 14, run almost the entire length of the back surface of the face plate 12. These vertical flanges define a channel within which the shutters 18 are mounted. The shutters 18 are kept separated by a tab 30 surrounding the small aperture 16 and are urged against the tab by the biasing means 22. The arms 20 on the shutters 18 effectively prevent rotation of the shutters in the channel defined by the flanges 28, since the arms span effectively across the width of the channel. A pair of small raised nipples 32 may be molded into the back surface of the face plate 12 on the opposite side of the large apertures 14 from the tab 30. These nipples 32 present a slight impediment to the movement of the shutter 18 therepast and may be useful in preventing easy operation of the device by children. A final feature shown on the back surface of the face plate is the raised post 34 molded into each corner of the channel defined by the vertical flanges 28. These raised posts 34, or an equivalent thereof, are used to affix a back plate to the back surface of the face plate 12, thereby completing the generally closed channel in which the shutters 18 are slidably positioned. Also, FIG. 2 shows a further feature of each shutter 18. The arms 20 on each shutter 18 are offset slightly to provide a tracking effect with a pair of vertical flanges on the inner surface of the back plate, which will be described below.

Figure 3:
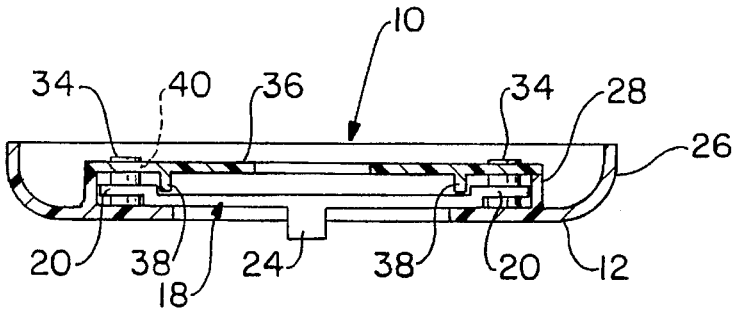
FIG. 3 is a cross-sectional view taken at Line 3—3 of FIG. 2.

The interaction of the shutters 18 in the channel formed between the face plate 12 and the back plate 36 is shown in cross-sectional view in FIG. 3, taken along Line 3—3 in FIG. 2. Back plate 36 has a pair of vertical flanges 38 positioned on the inner surface of the back plate so that the offset in the arms 20 of the shutter 18 is restrained from rotational movement. The flanged face plate periphery 26 described above is shown in this view. Likewise the height of raised posts 34 is also shown. Outwardly extending tab 24 on the shutter 18 is also illustrated. In the preferred embodiment taught, the actual affixation of back plate 36 to face plate 12 is achieved by passing the raised posts 34 through corresponding apertures 40 on the back plate. Once so positioned, the pieces can be held together by several known means. For example, if the face plate 12 and back plate 36 are both molded thermoplastics, especially a molded plastic acceptable for Underwriters Laboratories certification, the raised posts 34 may be thermally rivetted to the apertures 40 by heating the outer tips and melting them in place. In an alternate means of affixing, a suitable permanent adhesive can be placed on the posts 34 or in the aperture 40 before the posts are passed through the apertures. In yet a third means, posts 34 may be slightly larger than the apertures 40 to provide a friction fit. Even further means of affixing may be obvious to one of skill in this art.

Figure 4:
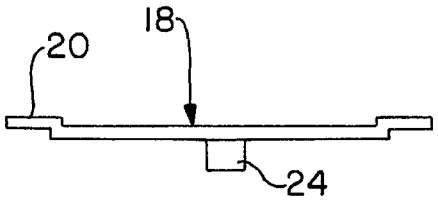
FIG. 4 is an edge elevational view of the shutter.

FIG. 4 shows an edge elevational view of the shutter 18, clearly disclosing arms 20 and tab 24. The offset nature of the arms 20 is also clearly disclosed. In the preferred embodiment known to the inventor, the shutter 18 will be molded from a thermoplastic, preferably the same thermoplastic used in molding face plate 12 and back plate 36.

Figure 5:
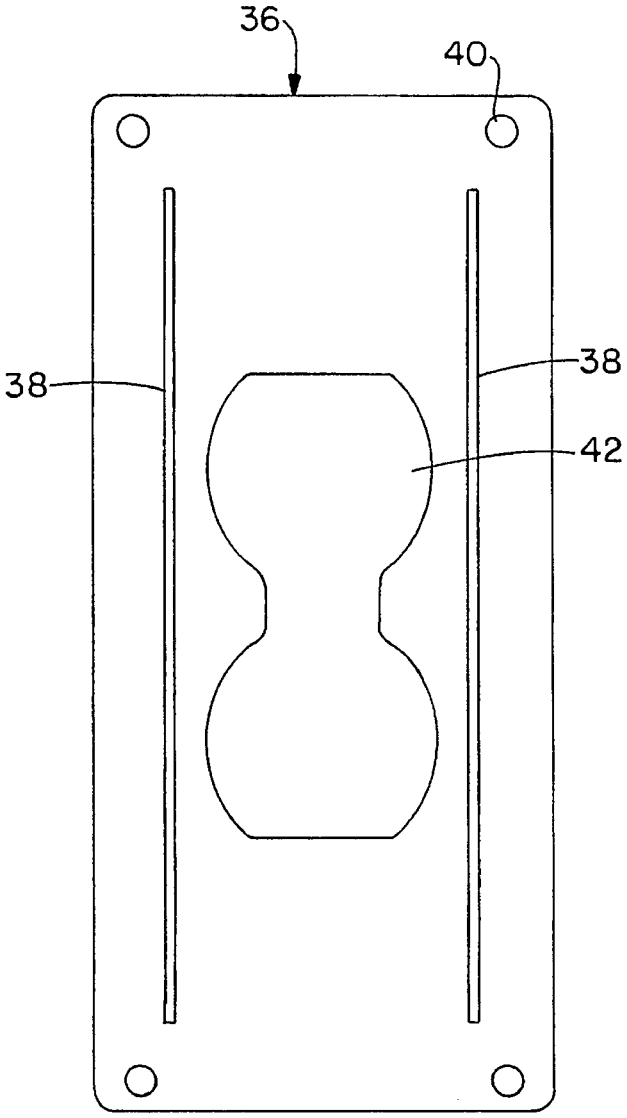
FIG. 5 is a plan view of the inside surface of the back plate of the safety device.

FIG. 5 shows back plate 36 of the present invention disclosing features of the inner surface thereof. Notable among the features shown are the vertical flanges 38 and apertures 40, both described above. The other prominent feature shown on the back plate 36 is a single hourglass-shaped aperture 42, which is shaped to provide unobstructed access to the female receptacles in the electrical outlet being covered. The narrowed middle portion of the hourglass-shaped aperture 42 allows passage of tab 30 therethrough, so that it may rest flush against the outlet box and effectively replaces the cover plate of the electrical outlet when the device 10 is affixed to the electrical outlet box through a screw or the like passing through small aperture 16. In the preferred embodiment, the larger portions of the hourglass-shaped aperture 42 are slightly larger than the female receptacles and the female receptacles have their face surface set at least flush with the inner surface of the back plate, if the face surface of the female receptacles is not actually slightly raised from the inner surface.

Referring briefly again to FIG. 3, attention is directed to the biasing means 22. As shown in the preferred embodiment, a loop 22 of elastomeric material, such as a rubber band, is hooked over a finger 44 on each arm 20. The loops 22 of the rubber band should be selected so that they are in slight tension when the pair of shutters 18 are in the fully closed position, as shown in FIG. 2, but they are capable of being extended sufficiently to allow each shutter to completely open and admit a male plug for engagement with the underlying female receptacle. It will be understood that the advantage of an elastomeric loop over a spring or wire is that the elastomeric material is electrically non-conductive, thereby obviating any hazard of a short circuit if the loop were to somehow be pushed into the holes of the female receptacle and thereby put into contact with electrical current. It will also be understood that the opening of one shutter 18 and the consequent increased tension on the loops 22 will increase the amount of tension required to open the other shutter. This coaction of the shutters provides an additional operational difficulty to a small child.

In the preferred embodiment, the shutter, face plate and back plate will all be molded from an injection-moldable thermoplastic. A preferred thermoplastic is a acrylonitrile-butadiene-styrene ("ABS") resin, having a rubber phase comprising a butadiene backbone structure to which the acrylonitrile and styrene monomers are grafted, the rubber phase being dispersed in a rigid styrene-acrylonitrile ("SAN") matrix. This class of polymers is well-known for its toughness and rigidity, and they are readily available commercially.

While in accordance with the patent statutes, the best mode and preferred embodiment of the present invention has been described, it is understood that the invention is not limited thereto, but rather is to be measured by the scope and spirit of the appended claims.

What is claimed is:

1. A safety device for covering a wall-mounted electrical outlet box having a pair of female receptacles for receiving a male plug and having means for receiving a screw to affix a cover plate, said safety device comprising:

a face plate having a front face and an opposing back face, the face plate having two large apertures therethrough to correspond to the two female receptacles in the outlet box such that each said female receptacle may be exposed through the corresponding large aperture when the face plate is positioned atop the outlet box, and a small aperture corresponding to the means for receiving a screw on the outlet box, the back face thereof having a pair of parallel flanges;

a back plate having a inner surface and an outer surface and an aperture therethough, said aperture being shaped and positioned to correspond to the pair of female receptacles in the outlet box when the outer surface of the back plate is positioned atop the outlet box;

said face plate and back plate having corresponding means for mating thereon so that the face plate and the back plate may be joined with the back face of the face plate, the inner surface of the back plate and the pair of parallel flanges on the back face defining a channel;

a first and a second shutter, one of said shutters corresponding to one of the large apertures on the face plate, each of said shutters comprising an imperforate shield member having a first arm and a second arm extending sidewardly therefrom and having an outwardly extending tab, each of said shutters positioned slidably within said channel so as to obstruct the corresponding one of the large apertures completely when in a first position and to provide access to a male plug through said corresponding one large aperture when in a second position; and each of said shutters urged into said first position by a means for biasing comprising a finger on each of said arms of each said shutter and a first and a second rubber band, the first rubber band positioned over the finger on the first arm of each of said shutters and the second rubber band positioned over the finger on the second arm of each of said shutters.

2. The safety device of claim 1, wherein the shutters are coacting, so that when one of the shutters is in the second position, tension on each of the rubber bands increases the force required to open the other of the shutters to the second position.

3. The safety device of claim 1 wherein the mating means comprises a plurality of raised posts on the back face of the face plate and a corresponding plurality of apertures through the back plate.

4. The safety device of claim 1 wherein the face plate has a flanged edge projecting from a periphery thereof.

5. The safety device of claim 1 wherein the aperture on the back plate is shaped like an hourglass.

6. The safety device of claim 1 wherein the face plate, the back plate, the shutters and the biasing means are electrically non-conductive.

7. The safety device of claim 6 wherein the face plate, the back plate and the shutters are formed from a thermoplastic material.

8. The safety device of claim 7 wherein the thermoplastic material is an acrylonitrile-butadiene-styrene resin.

9. A safety device for covering a wall-mounted electrical outlet box having a pair of female receptacles for receiving a male plug and having means for receiving a screw to affix a cover plate, said safety device comprising:

a face plate having a front face and an opposing back face, the face plate having two large apertures therethrough to correspond to the two female receptacles in the outlet box such that each said female receptacle may be exposed through the corresponding large aperture when the face plate is positioned atop the outlet box, and a small aperture corresponding to the means for receiving a screw on the outlet box, the back face thereof having a pair of parallel flanges; said face plate having a tab extending outwardly from the back face thereof between the large apertures;

a back plate having a inner surface and an outer surface and an aperture therethough, said aperture being shaped and positioned to correspond to the pair of female receptacles in the outlet box when the outer surface of the back plate is positioned atop the outlet box;

said face plate and back plate having corresponding means for mating thereon so that the face plate and the back plate may be joined with the back face of the face plate, the inner surface of the back plate and the pair of parallel flanges on the back face defining a channel;

a first and a second shutter, one of said shutters corresponding to one of the large apertures on the face plate, each of said shutters comprising an imperforate shield member having a first arm and a second arm extending sidewardly therefrom and having an outwardly extending tab, each of said shutters positioned slidably within said channel so as to obstruct the corresponding one of the large apertures completely when in a first position and to provide access to a male plug through said corresponding one large aperture when in a second position; and means for biasing, said biasing means connecting said first and second shutters, said biasing means urging each of said shutters into said first position.

10. The safety device of claim 9 wherein the biasing means comprises a finger on each of said arms of each said shutter and a first and a second rubber band, the first rubber band positioned over the finger on the first arm of each of said shutters and the second rubber band positioned over the finger on the second arm of each of said shutters.

11. The safety device of claim 10, wherein the shutters are coacting, so that when one of the shutters is in the second position, tension on each of the rubber bands increases the force required to open the other of the shutters to the second position.

12. The safety device of claim 9 wherein the mating means comprises a plurality of raised posts on the back face of the face plate and a corresponding plurality of apertures through the back plate.

13. The safety device of claim 9 wherein the face plate has a flanged edge projecting from a periphery thereof.

14. The safety device of claim 9 wherein the aperture on the back plate is shaped like an hourglass.

15. A safety device for covering a wall-mounted electrical outlet box having a pair of female receptacles for receiving a male plug and having means for receiving a screw to affix a cover plate, said safety device comprising:

a face plate having a front face and an opposing back face, the face plate having two large apertures therethrough to correspond to the two female receptacles in the outlet box such that each said female receptacle may be exposed through the corresponding large aperture when the face plate is positioned atop the outlet box, and a small aperture corresponding to the means for receiving a screw on the outlet box, the back face thereof having a pair of parallel flanges;

a back plate having a inner surface and an outer surface and an aperture therethough, said aperture being shaped and positioned to correspond to the pair of female receptacles in the outlet box when the outer surface of the back plate is positioned atop the outlet box;

said face plate and back plate having corresponding means for mating thereon so that the face plate and the back plate may be joined with the back face of the face plate, the inner surface of the back plate and the pair of parallel flanges on the back face defining a channel;

a first and a second shutter, one of said shutters corresponding to one of the large apertures on the face plate, each of said shutters comprising an imperforate shield member having a first arm and a second arm extending sidewardly therefrom and having an outwardly extending tab, each of said shutters positioned slidably within said channel so as to obstruct the corresponding one of the large apertures completely when in a first position and to provide access to a male plug through said corresponding one large aperture when in a second position; the arms of the shutters being offset slightly from the shield member and the inner surface of the back plate having a pair of parallel flanges molded thereon, so that the offset arms and parallel flanges interact to track the shutters within the channel; and means for biasing, said biasing means connecting said first and second shutters, said biasing means urging each of said shutters into said first position.

16. The safety device of claim 15 wherein the biasing means comprises a finger on each of said arms of each said shutter and a first and a second rubber band, the first rubber band positioned over the finger on the first arm of each of said shutters and the second rubber band positioned over the finger on the second arm of each of said shutters.

17. The safety device of claim 16, wherein the shutters are coacting, so that when one of the shutters is in the second position, tension on each of the rubber bands increases the force required to open the other of the shutters to the second position.

18. The safety device of claim 15 wherein the mating means comprises a plurality of raised posts on the back face of the face plate and a corresponding plurality of apertures through the back plate.

19. The safety device of claim 15 wherein the face plate has a flanged edge projecting from a periphery thereof.

20. The safety device of claim 15 wherein the aperture on the back plate is shaped like an hourglass.

* * * * *